US009126733B2

(12) United States Patent
Lieb

(10) Patent No.: US 9,126,733 B2
(45) Date of Patent: Sep. 8, 2015

(54) DRINKING STRAW PACKAGING SYSTEM AND METHOD

(76) Inventor: Jeremy B. Lieb, West Chester, OH (US)

( * ) Notice: Subject to any disclaimer, the term of this patent is extended or adjusted under 35 U.S.C. 154(b) by 523 days.

(21) Appl. No.: 13/449,631

(22) Filed: Apr. 18, 2012

(65) Prior Publication Data

US 2012/0261292 A1 Oct. 18, 2012

Related U.S. Application Data

(60) Provisional application No. 61/476,328, filed on Apr. 18, 2011.

(51) Int. Cl.

| | |
|---|---|
| ***B65D 85/20*** | (2006.01) |
| ***B65D 75/02*** | (2006.01) |
| ***B65D 75/38*** | (2006.01) |
| *B65D 85/08* | (2006.01) |

(52) U.S. Cl.

CPC ..... *B65D 75/02* (2013.01); *B65D 75/38* (2013.01); *B65D 85/08* (2013.01); *Y10T 29/49826* (2015.01)

(58) Field of Classification Search

CPC ..... B65D 75/02; B65D 75/38; B65D 85/08
USPC ..... 206/217, 443, 459.5, 497, 525, 446; 220/703, 705, 707–710; 229/103.1
See application file for complete search history.

(56) References Cited

U.S. PATENT DOCUMENTS

| | | | | |
|---|---|---|---|---|
| 2,849,321 | A * | 8/1958 | Yves et al. | 229/103.1 |
| 4,778,053 | A * | 10/1988 | Hakansson | 206/443 |
| 4,806,021 | A * | 2/1989 | Koudstaal et al. | 229/103.1 |
| 5,054,264 | A * | 10/1991 | Miller | 53/412 |
| 5,419,429 | A * | 5/1995 | Zimmerman et al. | 220/705 |
| 5,722,219 | A * | 3/1998 | Dobransky | 229/103.1 |
| 6,283,294 | B1 * | 9/2001 | Thorball et al. | 206/438 |
| 6,776,303 | B2 * | 8/2004 | Fripps | 220/710 |
| 7,789,665 | B2 * | 9/2010 | Choi | 434/156 |
| 2004/0226848 | A1 * | 11/2004 | Dunn-Rankin | 206/461 |
| 2007/0125744 | A1 * | 6/2007 | Samman | 220/710 |

* cited by examiner

*Primary Examiner* — Luan K Bui

(57) ABSTRACT

A method of packaging a drinking straw includes a cover configured to attach to and to enclose a first portion of the drinking straw. A second portion of the drinking straw may be inserted into a beverage by a waiter handling the cover attached to the drinking straw.

11 Claims, 4 Drawing Sheets

DRINKING STRAW PACKAGING SYSTEM AND METHOD

I. CLAIM OF PRIORITY

This application claims priority to U.S. Provisional Patent Application No. 61/476,328, filed on Apr. 18, 2011, which is incorporated by reference herein in its entirety for all purposes.

II. FIELD OF THE DISCLOSURE

The present disclosure relates generally to drinking straws, and more specifically, to the packaging of drinking straws.

III. BACKGROUND

A drinking straw is a tube used to transfer a beverage from a container into the mouth of the drinker by use of suction. The tube is generally thin and constructed from plastic. The drinking straw may be straight or may include an accordion-like hinge. Drinking straws are typically packaged by enclosing them completely within paper wrappers for sanitary considerations. A wrapper is sealed along the seams of its ends and lengths. Packaged drinking straws are typically provided alongside the beverage. A restaurant patron tears the paper wrapper to access the straw for insertion into the beverage.

IV. SUMMARY OF THE DISCLOSURE

A method of packaging a drinking straw includes a cover configured to attach to and to enclose a first portion of the drinking straw. A second, uncovered portion of the drinking straw may be inserted into a beverage by a waiter handling the cover attached to the drinking straw. As such, food service providers may provide drinks that already have straws placed into the beverages (e.g., without requiring patrons to so). An embodiment of a partial wrap straw system thus provides straws efficiently and in a sanitary manner. Service professionals may place straws in cups using the cover in a manner that does not contaminate the drinking straw or the beverage.

Drinking straws may be partially wrapped in a food safe material on the drinking end of the straw. The wrappers, or covers, may be available in a variety of colors to label drinks contents. Embodiments of the drinking straw covers may thus take on additional functions by indicating a type of beverage. For instance, the color or symbol printed on the cover may be used to designate a diet drink. Another embodiment of a cover may include a message for a consumer or a company logo.

In a particular embodiment, an apparatus includes a drinking straw and a cover configured to be attached to a first portion of the drinking straw. The cover may at least partially enclose the first portion of the drinking straw and may not enclose a second portion of the drinking straw. As such, the cover at least partially seals an outer surface of the first portion of the drinking straw from ambient air and contaminants.

The cover may be constructed from at least one of paper, metal, and plastic, and may include an anti-bacterial material. A logo or other design may be printed on the cover. The cover may be attached to the first portion of the drinking straw using at least one of an adhesive, a heat sealing treatment, a fastener, and a vacuum sealing treatment. A particular embodiment may include an additional cover configured to be attached to at least one of the cover and the drinking straw. The additional cover may at least partially enclose a second portion of the drinking straw and/or the cover.

According to another particular embodiment, a method includes packaging a drinking straw such that a cover at least partially encloses a first portion of the drinking straw. A cover may be formed that is configured to at least partially enclose a first portion of a drinking straw. The cover may be constructed using one or more of paper, metal, rubber, ceramic, anti-bacterial material, and plastic. The cover may be attached to the first portion of the drinking straw. For instance, the cover may be attached using at least one of an adhesive, a heat sealing treatment, a fastener, and a vacuum sealing treatment. The cover may be attached to the first portion such that the cover does not enclose a second portion of the drinking straw.

At least one of a color, logo, or other design may be printed on the cover. The printed material may pertain to the contents of the beverage or may include advertising material, for example. An additional cover may be attached to at least one of the cover and the drinking straw. The additional cover may at least partially enclose a second portion of the drinking straw. Where so configured, the additional cover may be torn from the cover. According to a particular embodiment, the additional cover may also enclose at least a portion of the cover. Where so desired, at least one of the first and second covers may be attached to a cover of another drinking straw.

These and other advantages and features that characterize the embodiments are set forth in the claims annexed hereto and forming a further part hereof. However, for a better understanding of the embodiments, and of the advantages and objectives attained through its use, reference should be made to the drawings and to the accompanying descriptive matter in which there are described exemplary embodiments.

V. BRIEF DESCRIPTION OF THE DRAWINGS

Figure 3:
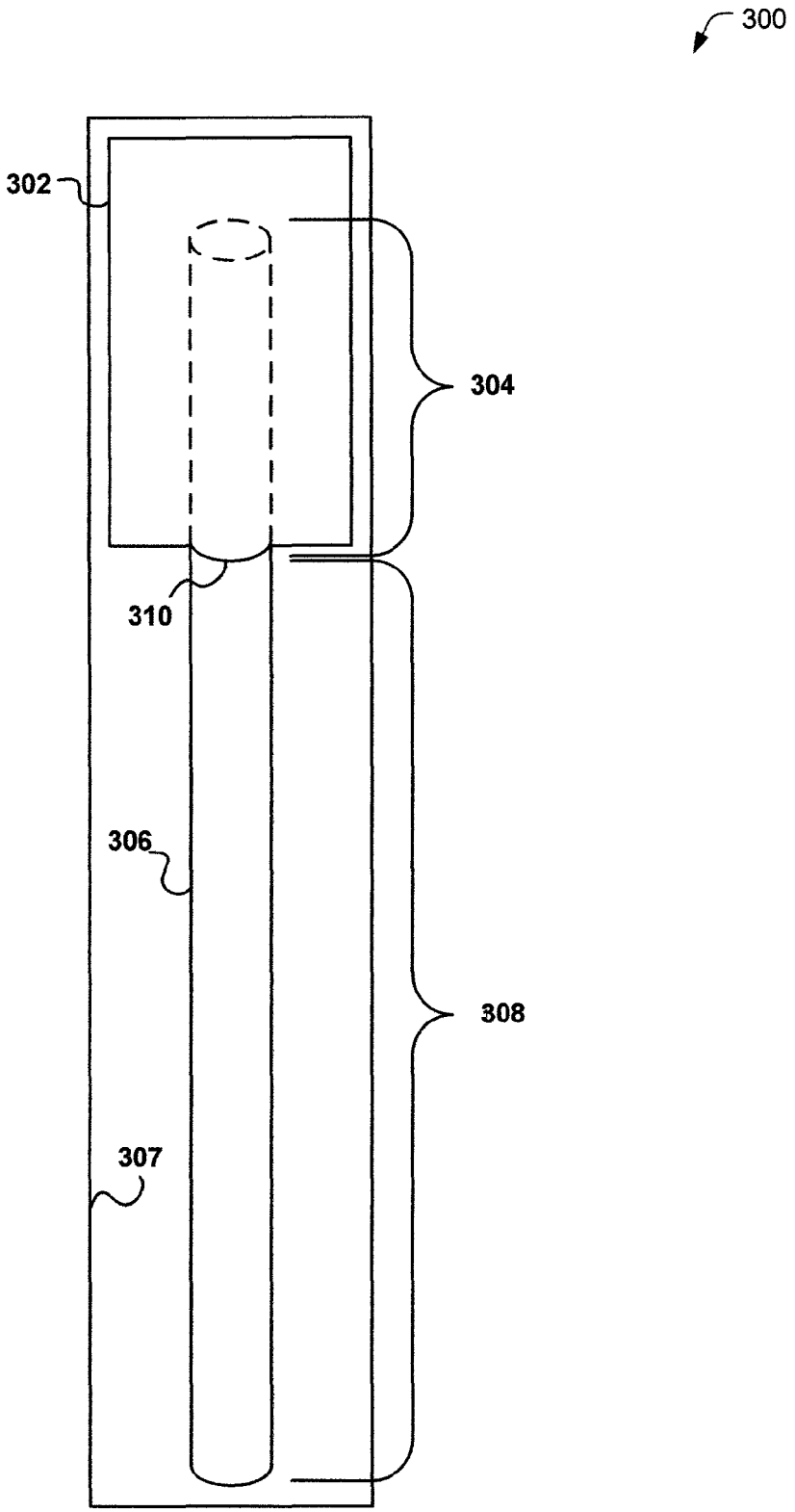
Figure 4:
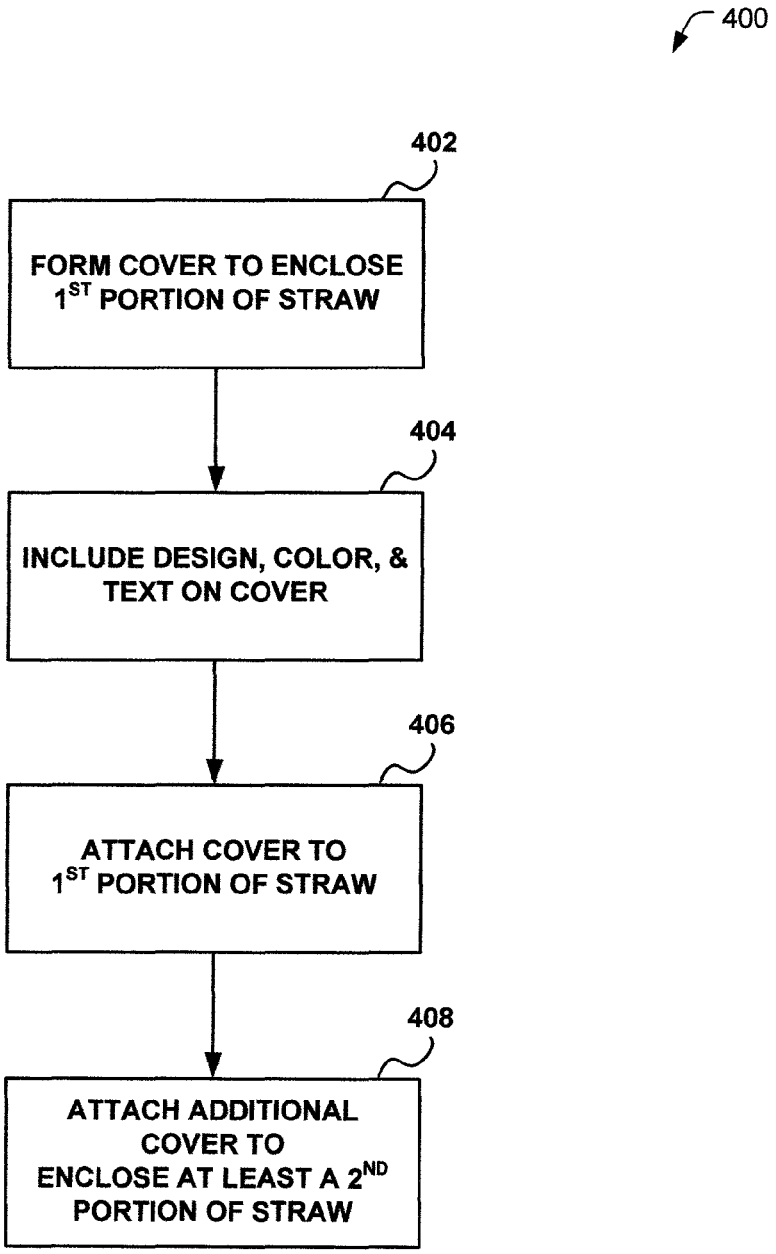

FIG. 3 is a diagram of an embodiment of a drinking straw system having a first cover that encloses a first portion of drinking straw and a second cover that encloses the first cover and a second portion of the drinking straw; and FIG. 4 is a flowchart illustrating an embodiment of a method of packaging a drinking straw such that a cover at least partially encloses a first portion of the drinking straw.

VI. DETAILED DESCRIPTION

An embodiment of a drinking straw packaging system includes a cover configured to attach to and to enclose a first portion of the drinking straw. A second portion of the drinking straw may be inserted into a beverage by a waiter handling the cover attached to the drinking straw.

Figure 1:
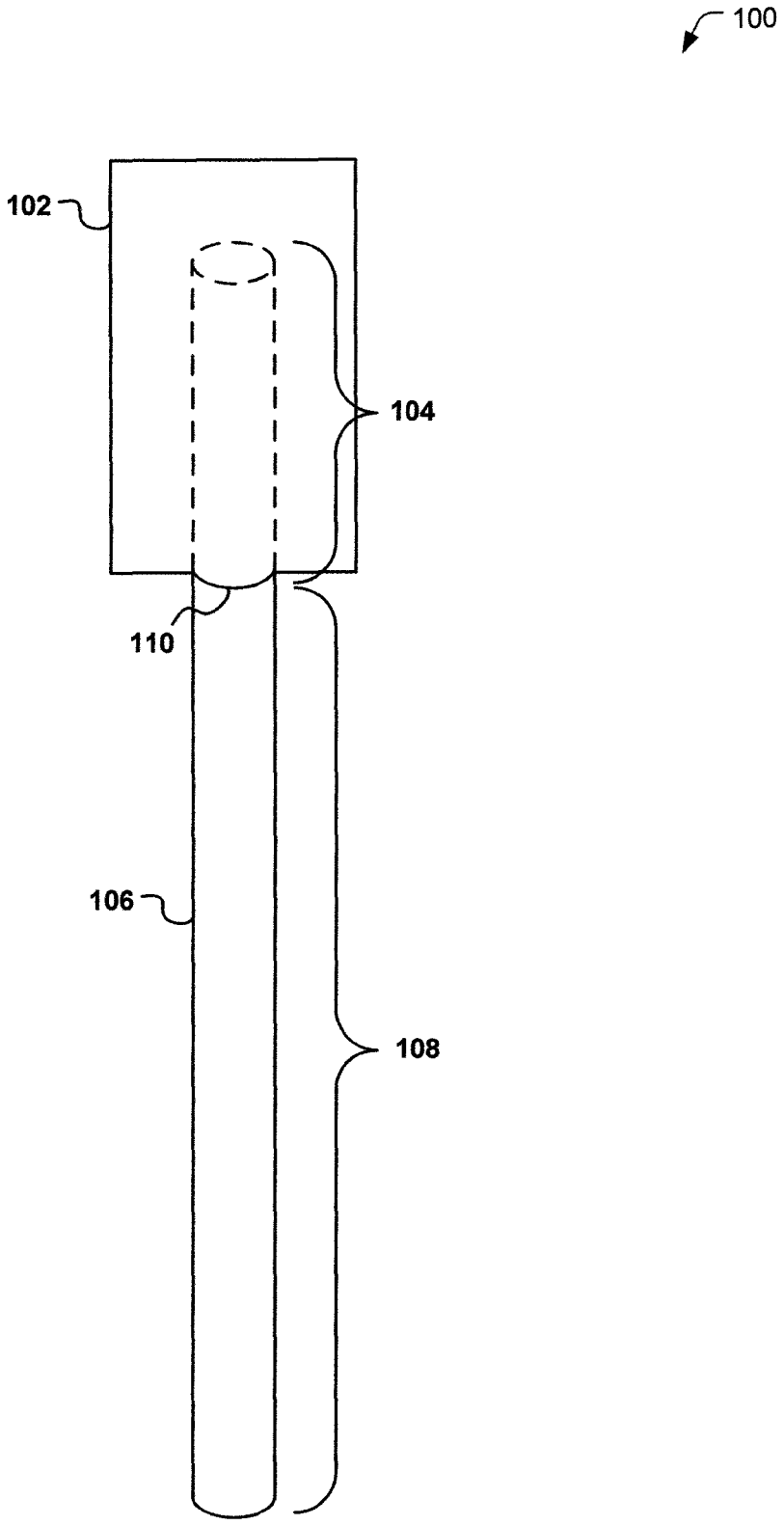
FIG. 1 is a diagram of an embodiment of a drinking straw system that partially encloses and seals a portion of a drinking straw.

Turning more particularly to the drawings, the embodiment of the drinking straw packaging system 100 of FIG. 1 includes a cover 102 that at least partially encloses a first portion 104 of a drinking straw 106. A second portion 108 of the drinking straw 106 may not be enclosed by the cover 102. As such, the second portion 108 of the drinking straw 106 may be inserted into a beverage by a waiter handling the cover 102, which is attached to the drinking straw 106.

An embodiment of the cover 102 may be attached to the first portion 104 of the drinking straw 106 using an adhesive or a fastener. Another embodiment may use a heat sealing technique or a vacuum sealing technique. For example, the cover 102 may be attached and sealed at a first end 110 of the cover 102. The cover 102 may additionally or alternatively contact all or an additional portion of an outside surface of the drinking straw 106.

The cover 102 may be removably attached to the first portion 104 such that a user may pull or tear the cover 102 from the drinking straw 106. The cover 102 may additionally be removably attached to a second cover of a second drinking straw (e.g., shown in FIG. 3) such that the drinking straws can be shipped together and separated at the time of use.

The cover 102 may include a color, logo, or other printed message. The printed message may indicate type of beverage (e.g., diet or regular). Another printed message may comprise an advertisement.

The cover 102 may be constructed of plastic, paper, ceramic, rubber, or metal. The cover 102 may be sterilized and may include an anti-bacterial surface coating. The cover 102 at least partially seals an outer surface of the first portion 104 of the drinking straw 106 from ambient air and potential contaminants.

Figure 2:
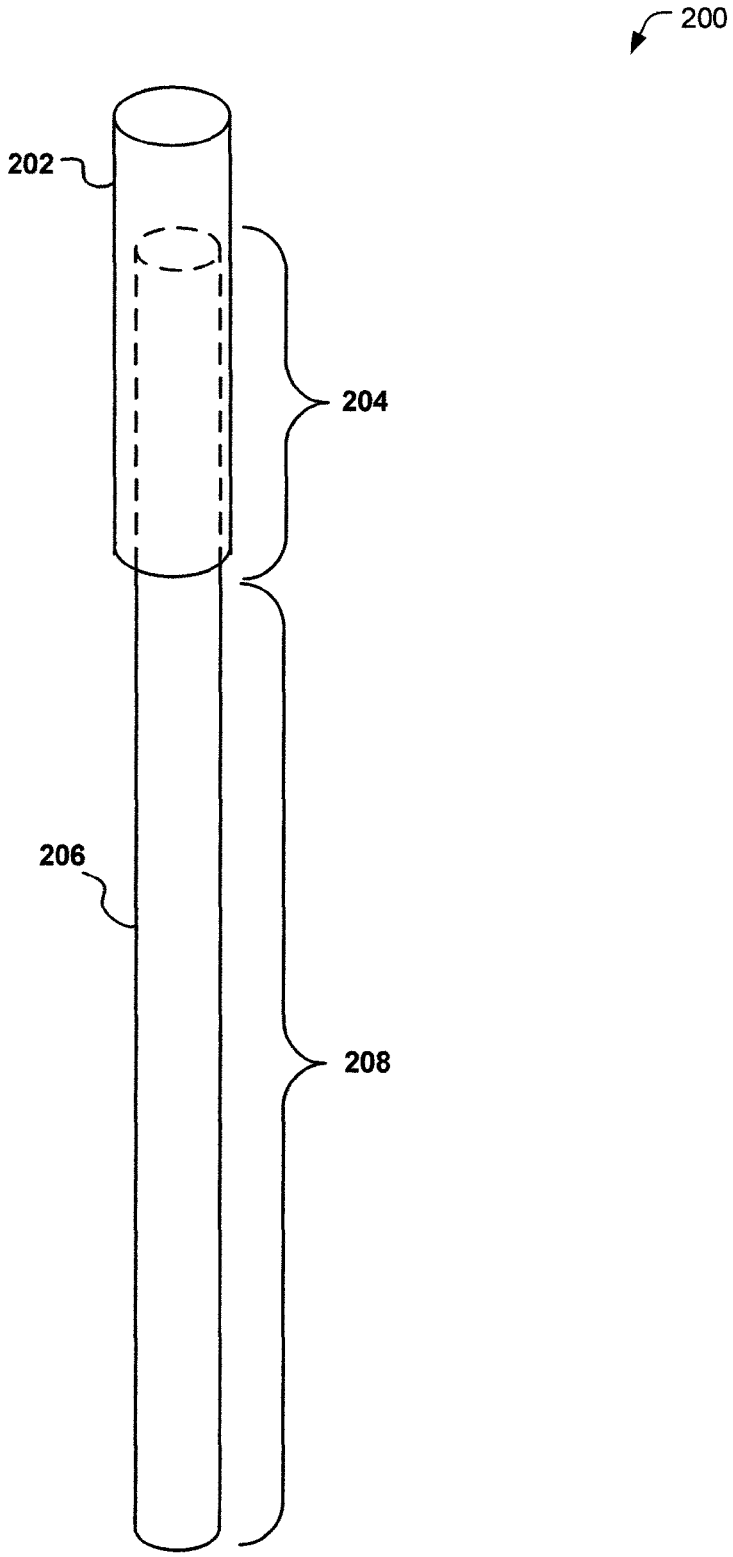
FIG. 2 is a diagram of an embodiment of a drinking straw system having a cap cover that encloses a first portion of drinking straw.

FIG. 2 is a diagram of an embodiment of a drinking straw system 200 having a cover 202 that comprises a cap structure that encloses a first portion 204 of a drinking straw 206. The cover 202 may be removably attached to the first portion 204 such that a user may pull the cover 202 from the drinking straw 206. The cover 202 may additionally be removably attached to a second cover of a second drinking straw (not shown) such that the drinking straws are held together when shipped and stored, and may be separated when used. The cover 202 may be constructed of plastic, paper, ceramic, or metal. The cover 202 may be sterilized and may include an anti-bacterial surface coating.

As in FIG. 1, an embodiment of the cover 202 may be removably attached to the first portion 204 of the drinking straw 206 using an adhesive or a fastener. Another embodiment may use a heat sealing technique or a vacuum sealing technique. The cover 202 may contact the first portion 204 of the drinking straw 206. The cover 202 at least partially seals outer surfaces of the first portion 204 of the drinking straw 206 from ambient air and potential contaminants.

FIG. 3 is a diagram of an embodiment of a drinking straw system 300 having a first cover 302 that encloses a first portion 304 of a drinking straw 306, and a second cover 307 that encloses a second portion 308 of the drinking straw 306. The second cover 307 may additionally enclose at least part of the first cover 302. The second cover 307 may provide a mechanism for protecting the second portion 308 of the drinking straw 306 from contamination during shipping and storage. A waiter may remove the second cover 307 from the first cover 302 and from the drinking straw 306 prior to inserting the drinking straw 306 into a beverage.

According to a particular embodiment, the drinking straw 306 and the first cover 302 may be positioned within the second cover 307. The same or another embodiment of the second cover 307 may be attached to one or both of the drinking straw 306 and the first cover 302. For example, the second cover 307 may be removably attached to the second portion 306 of the drinking straw 306 using an adhesive or a fastener. Another embodiment may use a heat sealing technique or a vacuum sealing technique. The second cover 307 may be attached to the first cover 302.

The first and second covers 302, 307 may be constructed of plastic, paper, ceramics, rubber, or metal. The first and second covers 302, 307 may be constructed from different materials. The first and second covers 302, 307 may be sterilized and may include an anti-bacterial surface coating. The first and second covers 302, 307 may at least partially seal outer surfaces of the first and second portions 304, 308 of the drinking straw 306 from ambient air and potential contaminants.

The first cover 302 may be attached to the first portion 304 of the drinking straw 206 using an adhesive or a fastener. Another embodiment may use a heat sealing technique or a vacuum sealing technique. For example, the first cover 302 may be attached and sealed at a first end 310 of the cover 302. According to another particular embodiment, the first cover 302 is attached in that it has been placed over the first portion 304, but may not be fastened directly to the first portion 304. The second cover 307 may contain the first cover 302. As such, the first cover 302 may be packaged over the first portion 304 or may be merely included in the second cover 307 such that a service provider who opens the second cover 307 may place it over the first portion 304. The second cover 207 may contact all of or a portion of an outside surface of the drinking straw 206.

The first cover 302 may be removably attached to the first portion 304 such that a user may pull or tear the first cover 302 from the drinking straw 306. Either or both of the first and second covers 302, 307 may additionally be removably attached to a third cover of a second drinking straw (not shown) such that the drinking straws are held together when shipped and stored, and may be separated when used.

FIG. 4 is a flowchart illustrating an embodiment of a method 400 of packaging a drinking straw such that a cover at least partially encloses a first portion of the drinking straw. Turning more particularly to the flowchart, a cover may be formed at 402. The cover may be configured to at least partially enclose a first portion of a drinking straw. For example, the cover 102 of FIG. 1 may be configured to at least partially cover the first portion 104 of the drinking straw 100. The cover may be constructed using one or more of paper, metal, anti-bacterial material, and plastic.

At least one of a color, logo, or other design may be printed on the cover at 404. The printed material may pertain to the contents of the beverage or may include advertising material, for example.

At 406, the cover may be attached to the first portion of the drinking straw. For instance, the cover 102 of FIG. 1 may be attached to the first portion 104 of the drinking straw 100. The cover may be attached using at least one of an adhesive, a heat sealing treatment, a fastener, and a vacuum sealing treatment. The cover may be attached to the first portion such that the cover does not enclose a second portion of the drinking straw.

At 408, an additional cover may be attached to at least one of the first cover and the drinking straw. The additional cover may at least partially enclose a second portion of the drinking straw. For example, the second cover 307 of FIG. 3 may enclose the second portion 308 of the drinking straw 306. According to a particular embodiment, the additional cover may also enclose at least a portion of the first cover. For instance, the second cover 307 of FIG. 3 may enclose both the second portion 308 of the drinking straw 306 and the first cover 302. Where desired, at least one of the first and second covers may be attached to a cover of another drinking straw.

While the various embodiments have been described in detail, it is not the intention of the Applicant to restrict, or any way limit the scope of the appended claims to such detail. The embodiments in their broader aspects are therefore not limited to the specific details, representative apparatus, method, and illustrative examples shown and described. Accordingly, departures may be made from such details without departing from the spirit or scope of Applicant's general inventive concept.

I claim:

1. An apparatus, comprising:

a drinking straw;

a first cover configured to be attached to a first portion of the drinking straw, wherein the first cover at least partially encloses the first portion of the drinking straw and does not enclose a remaining portion of the straw, wherein the first cover is configured to at least partially seal an outer surface of the first portion of the drinking straw from ambient air, wherein the first cover is attached to the first portion of the drinking straw using at least one of an adhesive, a heat sealing treatment, a fastener, and a vacuum sealing treatment; and a second cover configured to enclose a remaining portion of the drinking straw and at least a portion of the first cover, wherein the second cover is configured to at least partially seal an outer surface of the remaining portion of the drinking straw from ambient air.

2. The apparatus of claim 1, wherein the first cover comprises at least one of paper, rubber, metal, ceramic, and plastic.

3. The apparatus of claim 1, wherein the first cover comprises an anti-bacterial material.

4. The apparatus of claim 1, wherein a logo design is printed on the first cover.

5. The apparatus of claim 1, wherein at least one of a color and a design is printed on the first cover and is indicative of a drink into which the drinking straw is placed.

6. The apparatus of claim 1, wherein the first cover is attached to the second cover using at least one of an adhesive, a heat sealing treatment, a fastener, and a vacuum sealing treatment.

7. An apparatus, comprising:

a drinking straw;

a first cover configured to be attached to a first portion of the drinking straw, wherein the first cover at least partially encloses the first portion of the drinking straw and does not enclose a remaining portion of the straw, wherein the first cover is configured to at least partially seal an outer surface of the first portion of the drinking straw from ambient air; and a second cover configured to enclose a remaining portion of the drinking straw and at least a portion of the first cover, wherein the second cover is configured to at least partially seal an outer surface of the remaining portion of the drinking straw from ambient air, wherein the first cover is attached to the second cover using at least one of an adhesive, a heat sealing treatment, a fastener, and a vacuum sealing treatment.

8. The apparatus of claim 7, wherein the first cover comprises at least one of paper, rubber, metal, ceramic, and plastic.

9. The apparatus of clam 7, wherein the first cover comprises an anti-bacterial material.

10. The apparatus of claim 7, wherein a logo design is printed on the first cover.

11. The apparatus of claim 7, wherein at least one of a color and a design is printed on the first cover and is indicative of a drink into which the drinking straw is placed.

* * * * *